US009464423B2

(12) United States Patent
Dan et al.

(10) Patent No.: US 9,464,423 B2
(45) Date of Patent: Oct. 11, 2016

(54) EMERGENCY FLUSH APPARATUS AND METHOD

(71) Applicant: Shanghai Kohler Electronics, Ltd., Shanghai (CN)

(72) Inventors: Cao Dan, Pundong New Area (CN); Zhu Minghui, Pundong New Area (CN); Zhang Jie, Pundong New Area (CN); Wang Yingfeng, Pundong New Area (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 276 days.

(21) Appl. No.: 14/185,781

(22) Filed: Feb. 20, 2014

(65) Prior Publication Data

US 2014/0237712 A1 Aug. 28, 2014

(30) Foreign Application Priority Data

Feb. 21, 2013 (CN) ..... 2013 2 0079687 U

(51) Int. Cl.
*E03D 1/00* (2006.01)
*E03D 5/10* (2006.01)

(52) U.S. Cl.
CPC ..... *E03D 5/105* (2013.01); *E03D 1/00* (2013.01)

(58) Field of Classification Search
CPC ..... E03D 5/10
USPC ..... 4/300–442
See application file for complete search history.

(56) References Cited

U.S. PATENT DOCUMENTS 939,123 A 11/1909 Christy
3,052,892 A 9/1962 Witham
3,773,063 A 11/1973 Roosa
3,908,204 A 9/1975 Hopkins
4,707,868 A 11/1987 Hennessy
6,206,340 B1 3/2001 Paese et al.
6,782,568 B2 8/2004 Novak et al.
8,028,357 B2 10/2011 Ball
8,225,458 B1 * 7/2012 Hoffberg ..... E05F 3/102 16/49
8,698,333 B2 4/2014 Glasser et al.
2004/0232370 A1 * 11/2004 Parsons ..... E03D 3/02 251/129.04
2005/0062004 A1 * 3/2005 Parsons ..... E03C 1/05 251/129.04
2006/0164230 A1 * 7/2006 DeWind ..... B60K 35/00 340/461
2009/0121171 A1 * 5/2009 Parsons ..... E03C 1/05 251/129.15
2010/0252759 A1 * 10/2010 Guler ..... E03D 5/105 251/129.04
2010/0280677 A1 * 11/2010 Budike, Jr. ..... H05B 37/0272 700/296
2015/0276237 A1 * 10/2015 Daniels ..... F24D 19/10 237/2 A
2015/0276238 A1 * 10/2015 Matsuoka ..... F24D 19/10 700/278
2015/0276239 A1 * 10/2015 Fadell ..... F24D 3/08 237/2 A
2015/0276266 A1 * 10/2015 Warren ..... G05B 15/02 700/300

* cited by examiner

*Primary Examiner* — Lori Baker
(74) *Attorney, Agent, or Firm* — Foley & Lardner LLP

(57) ABSTRACT

An emergency flush apparatus for a toilet includes a flush driver module, a battery, and a processing unit operatively connected to the battery and the flush driver module. The emergency flush apparatus further includes a flush switch operatively connected to the battery and the processing unit, and a primary power supply operatively connected to the flush driver module. When the flush switch is activated, the processing unit detects a state of the flush driver module. Power is then supplied to the flush driver module from one of either the primary power supply or the battery in response to the detected state.

20 Claims, 1 Drawing Sheet

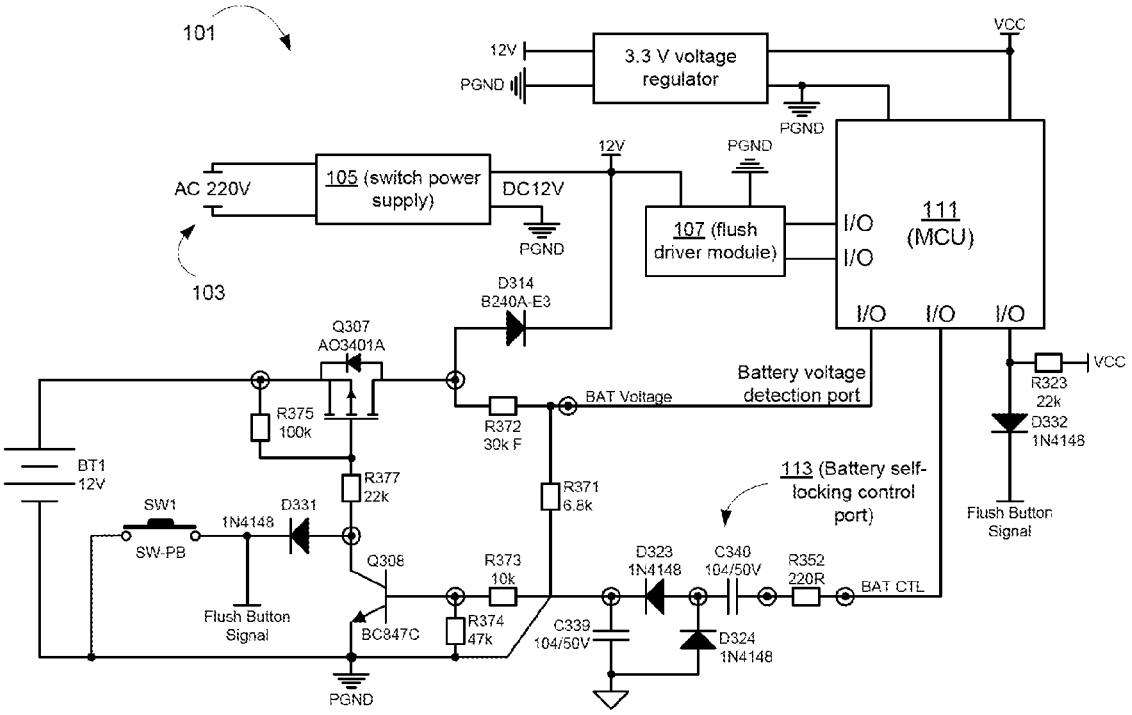
101
12V
PGND
3.3 V voltage regulator
VCC
PGND
AC 220V
105 (switch power supply)
DC12V
PGND
12V
PGND
107 (flush driver module)
I/O
I/O
111 (MCU)
I/O
I/O
I/O
103
D314
B240A-E3
Q307
AO3401A
R375
100k
R372
30k F
BAT Voltage
Battery voltage detection port
R323
22k
VCC
D332
1N4148
Flush Button Signal
BT1
12V
R377
22k
R371
6.8k
113 (Battery self-locking control port)
SW1
SW-PB
1N4148
D331
Q308
R373
10k
D323
1N4148
C340
104/50V
R352
220R
BAT CTL
Flush Button Signal
BC847C
R374
47k
C339
104/50V
D324
1N4148
PGND

EMERGENCY FLUSH APPARATUS AND METHOD

CROSS-REFERENCE TO RELATED APPLICATION

This application claims the benefit of and priority to Chinese Patent Application No. 201320079687.3, filed Feb. 21, 2013, which is incorporated by reference herein in its entirety.

BACKGROUND

The present application relates generally to a flush apparatus for a toilet. More specifically, the present application relates to an emergency flush apparatus and method for a toilet.

Some one-piece toilets currently on the market do not include a water tank. Thus, one-piece toilets typically include an electronically operated flush driver valve (e.g., a solenoid valve) to control a flow of water into the toilet to allow the toilet to be flushed (i.e., to discharge the contents of the toilet bowl). One drawback with such conventional one-piece toilets is that in the event of a power outage, the electronically driven flush valve cannot be operated (i.e., the toilet cannot be flushed). Thus, if a user uses the toilet during a power outage, he or she will be faced with a dilemma because the toilet cannot be flushed after being used. Although additional mechanical parts may be provided on the toilet to carry out the flushing operation in the event of a power outage/failure, the additional parts would make the toilet more complex and cumbersome. Moreover, the additional mechanical parts would negatively affect the appearance of the toilet.

There is a need to improve one-piece toilets employing electronically driven flush valves, and in particular, to provide an apparatus and a method for performing an emergency flush operation in the event of a power outage. There is a need for such a device to be compact such that it does not affect the appearance of the toilet.

SUMMARY

One embodiment of the present application relates to an emergency flush apparatus for an intelligent toilet. The apparatus includes a flush switch (SW1), a primary power supply, and a flush driver module. The voltage output terminal of the primary power supply is connected to the power input terminal of the flush driver module. The apparatus further includes a battery, a battery voltage detection module, a battery self-locking module and a processing unit. The flush switch (SW1) is connected in the circuit between the negative pole of the battery and the positive pole of the battery and is connected to the processing unit. The signal input terminal of the battery voltage detection module is connected to the voltage output terminal of the battery. The signal output terminal of the battery voltage detection module is connected to the processing unit. One end of the battery self-locking module is connected to the processing unit. The other end thereof is connected to the voltage output terminal of the battery.

The battery voltage detection module can include a first resistor (R371) and a second resistor (R372). The first resistor (R371) and the second resistor (R372) may be connected in series. One end of the resistors that are connected in series is grounded, the other end thereof is connected to the voltage output terminal of the battery, and the connection point between the first resistor (R371) and the second resistor (R372) is connected to the battery voltage signal input terminal of the processing unit.

The voltage output terminal of the battery may be connected to a first transistor (Q307). The first transistor (Q307) is a P-type field effect transistor. The gate of the first transistor (Q307) is connected to the positive pole of the battery via a third resistor. The gate of the first transistor (Q307) is connected to one end of the flush switch via a fourth resistor. The other end of the flush switch (SW1) is connected to the negative pole of the battery. The source of the first transistor (Q307) is connected to the positive pole of the battery. The drain of the first transistor (Q307) is connected to the power input terminal of the flush driver module. One end of the second resistor (R372) is connected to the voltage output terminal of the battery via the drain and the source of the first transistor (Q307).

The battery self-locking module may include a first capacitor (C339), a second capacitor (C340), a third diode (D323), a fourth diode (D324), and a second transistor (Q308). The second transistor (Q308) is a NPN-type triode. One end of the first capacitor (C339) is grounded, and the other end thereof is connected to the base of the second transistor and connected to the cathode of the third diode (D323). The anode of the third diode (D323) is connected to the cathode of the fourth diode (D324) and connected to one end of the second capacitor (C340). The other end of the second capacitor (C340) is connected to the self-locking control port of the processing unit. The anode of the fourth diode (D324) is grounded. The emitter of the second transistor (Q308) is grounded. The collector of the second transistor (Q308) is connected to the fourth resistor.

A fifth resistor (R373) and a sixth resistor (R374) may be connected in series, one end of the resistors that are connected in series is grounded, the other end thereof is connected to the cathode of the third diode, and the connection point between the fifth resistor (R373) and the sixth resistor (R374) may be connected to the base of the second transistor (Q308).

The flush driver module may include a solenoid valve. The processing unit may be a microcontrol unit (MCU). The flush switch (SW1) is connected to the flush signal input terminal of the processing unit. The second capacitor (C340) may be connected to the self-locking control port of the processing unit via a seventh resistor (R352).

Yet another embodiment of the present application relates to an emergency flush apparatus for a toilet which includes a flush driver module, a battery, and a processing unit operatively connected to the battery and the flush driver module. The emergency flush apparatus further includes a flush switch operatively connected to the battery and the processing unit, and a primary power supply operatively connected to the flush driver module. When the flush switch is activated, the processing unit detects a state of the flush driver module and power is supplied to the flush driver module from one of either the primary power supply or the battery in response to the detected state.

Yet another embodiment of the present application relates to an emergency flush apparatus for a toilet which includes a flush driver module, a battery, and a processing unit operatively connected to the battery and the flush driver module. The emergency flush apparatus further includes a flush switch operatively connected to the battery and the processing unit, and a primary power supply operatively connected to the flush driver module. The emergency flush apparatus further includes a battery voltage detection module having a signal input terminal and a signal output terminal. The signal input terminal is connected to the battery and the signal output terminal is connected to the processing unit. The emergency flush apparatus further includes a battery self-locking module operatively connected to the processing unit and to the battery. In a first operational state, the flush driver module is powered by the primary power supply, and in a second operational state, the flush driver module is powered by the battery.

Yet another embodiment of the present application relates to an emergency flush method that includes the step of providing an emergency flush apparatus including a flush driver module, a battery, a processing unit operatively connected to the battery and the flush driver module, a flush switch operatively connected to the battery and the processing unit, and a primary power supply operatively connected to the flush driver module. The method further includes detecting a state of the flush driver module and selecting one of either the primary power supply or the battery to supply power to the flush driver module in response to the detected state.

The present application provides an apparatus and a method for performing an emergency flush operation in the event of a power outage that is simple, compact, and does not affect the appearance of the toilet.

BRIEF DESCRIPTION OF THE FIGURE

FIG. 1 is a circuit diagram of an emergency flush apparatus according to an exemplary embodiment of the present application.

DETAILED DESCRIPTION

According to an exemplary embodiment shown in FIG. 1, an emergency flush apparatus 101 for a toilet includes a primary power supply 105 and a flush driver module 107. The primary power supply 105 includes a voltage output terminal that is connected to a power input terminal of the flush driver module 107. The emergency flush apparatus 101 further includes a battery (e.g., the battery BT1shown in FIG. 1), a flush switch (e.g., the flush SW1 shown in FIG. 1), a battery voltage detection module, a battery self-locking module and a processing unit (e.g., the MCU 111 shown in FIG. 1).

As shown in FIG. 1, the primary power supply 105 is used to convert AC (e.g., the AC 220 V source 103) to DC suitable for the operation of the flush driver module 107. For example, as shown in FIG. 1, the primary power supply 105 is a power supply apparatus that converts 220 V commercial power to 12 V DC.

The flush driver module 107 may include a flush driver circuit that includes a solenoid valve. The flush driver module may be configured to be any one of a variety of existing flush driver devices.

The battery BT1 may be configured to be any one of a variety of appropriate batteries, such as a nickel-hydrogen battery, a nickel-chromium battery, a lithium battery, and the like. The output voltage of the battery may be configured to be the same as the operating voltage of the flush driver module. For example, the voltage of the battery (e.g., 12V) is the same as the output voltage of the primary power supply.

The processing unit may be configured to include one or more appropriate microcontrol units (MCUs). According to the exemplary embodiment shown in FIG. 1, the processing unit is an MCU 111 that is a 16-bit single-chip microcomputer.

As shown in FIG. 1, the flush switch SW1 is connected between a negative pole of the battery BT1 and a positive pole of the battery BT1, and is also connected to the processing unit MCU 111. According to various exemplary embodiments, the flush switch may be configured to be a button switch.

According to the exemplary embodiment shown in FIG. 1, the voltage detection module includes a voltage divider. The voltage divider may be configured to include one or more voltage dividing resistors. As shown in FIG. 1, the voltage divider includes a first resistor R371 and a second resistor R372 connected in series. The end of the first resistor R371 is grounded and the end of the second resistor R372 is connected to the voltage output terminal of the battery. The voltage output terminal of the battery is connected to the power input terminal of the flush driver module via a first diode D314. The first resistor R371 and the second resistor R372 are connected to a corresponding input terminal of the processing unit MCU 111.

The voltage output terminal of the battery BT1 is further connected to a first transistor Q307. As shown in FIG. 1, the first transistor Q307 is a P-type field effect transistor AO3401A, wherein a gate of the first transistor Q307 is connected to the positive pole of the battery BT1 with a third resistor R375. Another gate of the first transistor Q307 is connected to one end of the flush switch SW1 with a fourth resistor R377, and the other end of the flush switch SW1 is connected to the negative pole of the battery BT1. The source of the first transistor Q307 is connected to the positive pole of the battery BT1 and the drain of the first transistor Q307 is connected to the power input terminal of the flush driver module.

According to an emergency flush process in accordance with the emergency flush apparatus shown in FIG. 1, when the flush switch SW1 is triggered (e.g., activated), the MCU 111 first determines whether the flush driver module 107 is powered by the primary power supply 105 or by the battery BT1. As shown in FIG. 1, the flush switch SW1 is connected to the flush signal input terminal of the MCU 111. The flush switch SW1 is configured such that it is effective at low power levels. For example, as shown in FIG. 1, the flush switch SW1 is connected to the flush signal input terminal of the processing unit via a fifth diode D332 which in turn is connected to a pull-up resistor R323. When the MCU 111 receives a switch signal from the flush signal input terminal, it may immediately detect the state of the flush driver module. If the primary power supply 105 cannot supply power to the flush driver module due to a mains power outage or other failure, the flush driver module will be in a power shutdown state. If the power shutdown state is detected by the MCU 111, the MCU 111 can determine that the flush driver module should be powered by the battery BT1.

In case of a failure of the primary power supply (e.g., a power outage), the battery is caused to supply power to the flush driver module. When the battery begins to supply power to the flush driver module, the battery voltage detection module begins to detect the battery voltage. If the detection results show that the battery voltage is sufficient to power the flush driver module, the battery self-locking module maintains a supply of power from the battery to the flush driver module, thereby allowing the flush driver module to operate and control the water pathway to allow the toilet to flush.

According to the exemplary embodiment shown in FIG. 1, the operating process of the battery voltage detection module during an emergency flush process is as follows:

When a user presses (e.g., activates) the flush switch SW1, the battery BT1 forms a circuit with the flush switch SW1, a third resistor R375, a fourth resistor R377, and a second diode D331, such that the first transistor Q307 is on and forms a circuit with the battery BT1, the first transistor Q307, the first resistor R371, and the second resistor R372. Since the MCU in this embodiment has a 3.3 V power supply, voltage sampling can only be performed when the battery voltage is divided to ensure that the sampled voltage is below 3.3 V. As shown in FIG. 1, the voltage divider including the first resistor R371 and the second resistor R372 divides the battery voltage, and the obtained voltage is sent to the MCU 111 for AD sampling. The battery voltage is determined to be sufficient to power the flush driver module by determining whether the obtained voltage value is higher than a set threshold value in the MCU. More specifically, when the obtained value is higher than or equal to the set threshold value, the battery is determined to have a sufficient amount of electricity to power the flush driver module, and when the obtained value is lower than the set threshold value, the battery is determined to have an insufficient amount of electricity to power the flush driver module.

According to the exemplary embodiment shown in FIG. 1, the battery self-locking module includes a rectifier circuit and a switch circuit. The rectifier circuit includes a voltage multiplier circuit composed of a first capacitor C339, a second capacitor C340, a third diode D323, and a fourth diode D324. The voltage multiplier circuit is used to rectify PWM pulse signals transmitted from the MCU. After rectification, a DC voltage is obtained and is applied on the switch circuit. As shown in FIG. 1, the switch circuit includes a second transistor Q308. The second transistor Q308 may be configured to be an NPN-type triode BC847C. The base of the second transistor Q308 is connected to the output terminal of the voltage multiplier circuit, and the output terminal of the voltage multiplier circuit is connected to the base of the second transistor Q308 with a voltage divider formed by a fifth resistor R373 and a sixth resistor R374. As shown in FIG. 1, the fifth resistor R373 and the sixth resistor R374 are connected in series with one end of the resistors being grounded and the other end being connected to the cathode of the third diode D323. The fifth resistor R373 and the sixth resistor R374 are connected to each other at a base of the second transistor Q308. An emitter of the second transistor Q308 is grounded. A collector of the second transistor Q308 is connected to the fourth resistor R377.

According to the exemplary embodiment shown in FIG. 1, the operating process of the battery self-locking module during an emergency flush process is as follows: When the MCU 111 determines that the power supply is from the battery BT1 (i.e., the primary power supply is in the power shutdown state), one path of PWM pulse signals is outputted from the corresponding control port (I/O) of the MCU 111, which becomes a DC level signal through filtering and rectification by the first and second capacitors C339, C340 and third and fourth diodes D323, D324, to control the triode Q308. When the triode Q308 is on, it is configured to turn the MOS transistor Q307 on such that the battery voltage (e.g., 12 V) may be continuously supplied from the battery BT1 to the power input terminal of the flush driver module. Even if a user releases the flush switch SW1, the flush driver module may still be connected to the battery via triode Q308 and operate normally. When the emergency flush process ends, the corresponding port of the MCU 111 stops the output of the PWM pulse signals and the triode Q308 is shut off, which in turn shuts off the MOS transistor Q307. The battery no longer provides power to the flush driver module and the flush driver module is powered down.

The apparatus and method disclosed herein is particularly advantageous in that a toilet employing the emergency flush apparatus can be flushed by a user in the event of a power outage or failure of the primary (e.g., mains wall-outlet power) power supply. Additionally, the apparatus and method disclosed herein is simple, compact, and does not affect the aesthetics of a toilet employing the disclosed apparatus.

Those skilled in the art should understand that the above circuit structures of the battery voltage detection module and the battery self-locking module are exemplary, and other circuit structures that can perform the above functions are all encompassed by the scope of the present application.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

It is important to note that the construction and arrangement of the emergency flush apparatus and process as shown in the various exemplary embodiments is illustrative only. Although only a few embodiments have been described in detail in this disclosure, those skilled in the art who review this disclosure will readily appreciate that many modifications are possible (e.g., variations in the arrangement of elements, values of parameters, configurations, etc.) without materially departing from the novel teachings and advantages of the subject matter described herein. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element (e.g., battery control module, battery self-locking module, processing unit, etc.) disclosed in one embodiment may be incorporated or utilized with any other embodiment disclosed herein.

What is claimed is:

1. An emergency flush apparatus for a toilet comprising:

a flush driver module;

a battery;

a processing unit operatively connected to the battery and the flush driver module;

a flush switch operatively connected to the battery and the processing unit; and a primary power supply operatively connected to the flush driver module;

wherein when the flush switch is activated the processing unit detects a state of the flush driver module; and wherein power is supplied to the flush driver module from one of either the switch power supply or the battery in response to the detected state.

2. The emergency flush apparatus of claim 1, wherein when the primary power supply is unable to supply power to the flush driver module, the flush driver module is determined by the processing unit to be in a power shutdown state.

3. The emergency flush apparatus of claim 2, wherein when the flush driver module is in the power shutdown state, the processing unit causes the battery to supply power to the flush driver module.

4. The emergency flush apparatus of claim 3, further comprising a battery voltage detection module having a signal input terminal and a signal output terminal, wherein the signal input terminal is connected to the battery and the signal output terminal is connected to the processing unit; and wherein when the flush driver module is in the power shutdown state, the battery voltage detection module detects a voltage of the battery.

5. The emergency flush apparatus of claim 4, further comprising a battery self-locking module operatively connected to the processing unit and the battery; and wherein when the flush driver module is in the power shutdown state, the battery self-locking module maintains a supply of power from the battery to the flush driver module if the detected battery voltage is judged sufficient to power the flush driver module.

6. The emergency flush apparatus of claim 5, wherein the battery voltage detection module includes a voltage divider.

7. The emergency flush apparatus of claim 6, wherein the battery self-locking module includes a rectifier circuit and a switch circuit.

8. The emergency flush apparatus of claim 7, wherein the processing unit is a battery powered microcontrol unit does not rely on the primary power supply for operation.

9. An emergency flush apparatus for a toilet comprising:

a flush driver module;

a battery;

a processing unit operatively connected to the battery and the flush driver module;

a flush switch operatively connected to the battery and the processing unit;

a switch power supply operatively connected to the flush driver module;

a battery voltage detection module having a signal input terminal and a signal output terminal, wherein the signal input terminal is connected to the battery and the signal output terminal is connected to the processing unit; and a battery self-locking module operatively connected to the processing unit and the battery;

wherein in a first operational state the flush driver module is powered by the switch power supply, and in a second operational state the flush driver module is powered by the battery.

10. The emergency flush apparatus of claim 9, wherein in the second operational state the switch power supply is unable to supply power to the flush driver module.

11. The emergency flush apparatus of claim 10, wherein in the second operational state the battery voltage detection module detects a voltage of the battery and the battery self-locking module maintains a supply of power from the battery to the flush driver module if the detected battery voltage is sufficient to power the flush driver module.

12. The emergency flush apparatus of claim 11, wherein the voltage detection module includes a voltage divider.

13. The emergency flush apparatus of claim 12, wherein the battery self-locking module includes a rectifier circuit and a switch circuit.

14. The emergency flush apparatus of claim 13, wherein the processing unit is a battery powered microcontrol unit that does not rely upon the primary power supply for operation.

15. An emergency flush method comprising:

providing an emergency flush apparatus comprising:

a flush driver module;

a battery;

a processing unit operatively connected to the battery and the flush driver module;

a flush switch operatively connected to the battery and the processing unit; and a switch power supply operatively connected to the flush driver module;

detecting a state of the flush driver module; and selecting one of either the primary power supply or the battery to supply power to the flush driver module in response to the detected state.

16. The method of claim 15, wherein detecting a state of the flush driver module includes determining whether the switch power supply can power the flush driver module.

17. The method of claim 16, further comprising:

providing a battery voltage detection module having a signal input terminal and a signal output terminal, wherein the signal input terminal is connected to the battery and the signal output terminal is connected to the processing unit;

detecting a voltage of the battery with the battery voltage detection module; and determining whether the detected battery voltage is sufficient to power the flush driver module.

18. The method of claim 17, further comprising:

providing a battery self-locking module operatively connected to the processing unit and to the battery; and maintaining a supply of power from the battery to the flush driver module if the detected battery voltage is sufficient to power the flush driver module.

19. The method of claim 18, wherein detecting a voltage of the battery includes dividing the battery voltage and sending an obtained voltage to the processing unit.

20. The method of claim 19, wherein determining whether the voltage is sufficient to power the flush driver module includes comparing the value of the obtained voltage to a threshold value programmed in the processing unit.

* * * * *